US011767654B2

(12) United States Patent
Jackson

(10) Patent No.: US 11,767,654 B2
(45) Date of Patent: Sep. 26, 2023

(54) WORK IMPLEMENT FOR CONSTRUCTION VEHICLE

(71) Applicant: Caterpillar Inc., Peoria, IL (US)

(72) Inventor: Robert Alan Jackson, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 396 days.

(21) Appl. No.: 17/009,862

(22) Filed: Sep. 2, 2020

(65) Prior Publication Data

US 2022/0064898 A1 Mar. 3, 2022

(51) Int. Cl.
*E02F 3/76* (2006.01)
*E02F 9/18* (2006.01)
*E02F 3/815* (2006.01)

(52) U.S. Cl.
CPC ..... *E02F 3/7609* (2013.01); *E02F 3/8152* (2013.01); *E02F 9/18* (2013.01)

(58) Field of Classification Search
CPC ... E02F 9/18; E02F 3/7609; E02F 3/80; E02F 3/815; E02F 3/8152; E02F 3/8157; E01H 5/066
See application file for complete search history.

(56) References Cited

U.S. PATENT DOCUMENTS 2,139,625 A * 12/1938 Pruss ..... E01H 5/06 37/270
3,991,891 A 11/1976 Cox
3,998,342 A 12/1976 Myers
4,151,921 A 5/1979 Myers et al.
4,864,748 A * 9/1989 Boyer ..... E02F 5/223 414/526
7,918,042 B2 * 4/2011 Ropog ..... E01H 5/066 37/281
9,546,467 B2 1/2017 Paski
11,346,075 B2 * 5/2022 Hu ..... E02F 3/3636
2012/0153605 A1 * 6/2012 Hetzel ..... B62D 49/0628 280/755
2014/0079520 A1 * 3/2014 Kent ..... E02F 3/401 414/722
2014/0137444 A1 * 5/2014 Srinivasa Rengan ..... E02F 9/18 37/444

* cited by examiner

*Primary Examiner* — Thomas B Will
*Assistant Examiner* — Audrey L Lusk

(57) ABSTRACT

A construction vehicle includes a frame and a linkage assembly. The linkage assembly includes a linkage member and a work implement. The work implement includes a wall structure defining a first edge, a second edge, and a material engaging portion. The work implement also includes a first support plate disposed proximate to the first edge. The first support plate defines a first opening proximate to the material engaging portion. The work implement further includes a second support plate disposed. The second support plate defines a second opening proximate to the material engaging portion. The work implement includes a conduit coupled to the first support plate and the second support plate and defining a cavity. Each of the first and second openings are aligned with the cavity. Further, the work implement also includes a weight member removably received within the cavity defined by the conduit.

20 Claims, 4 Drawing Sheets

WORK IMPLEMENT FOR CONSTRUCTION VEHICLE

TECHNICAL FIELD

The present disclosure relates to a work implement for a construction vehicle.

BACKGROUND

A construction vehicle, such as a track type tractor or a dozer, includes a work implement. The work implement may include a blade for various material handling operations. Generally, miscellaneous accessories/attachments may be added to or removed from a rear end of the construction vehicle, as per application requirements. Such accessories/attachments may affect a weight and a balance of the construction vehicle. It is desirable to maintain the weight and the balance of the construction vehicle as these factors in turn effect a reliability, stability, ride quality, and digging/ripping performance of the construction vehicle. Further, it is also desirable to maintain the weight and the balance of the construction vehicle to control accelerated wear of one or more components of the construction vehicle, such as an undercarriage system.

Conventionally, additional attachments or a counterweight may be associated with a component, such as the work implement, disposed at a front end of the construction vehicle to achieve optimal weight and balance of the construction vehicle. The counterweight may address any disturbances in the weight and the balance of the construction vehicle. As the construction vehicle is exposed to vibrations, addition of the counterweight can be challenging as the counterweight needs to be adequately supported and constrained to reduce a probability of loosening and/or effecting a functioning of the construction vehicle and its attachments. Further, addition of the counterweight may be time consuming, cumbersome, and a skill-oriented job. In some examples, the counterweight may shift a centre of gravity, cause uneven weight distribution, or disturbance in height of the work implement from a ground surface.

U. S. Patent Number 2014/0137444 describes a loader bucket which is adapted for use with a machine. The loader bucket includes a first side section, a second side section and a rear section. The rear section has a substantially arcuate portion so that a bottom section extends from a lower end of the arcuate portion. Further, a top section extends from an upper end of the arcuate portion. One or more counterweights are disposed on the top section of the loader bucket.

SUMMARY OF THE DISCLOSURE

In an aspect of the present disclosure, a construction vehicle is provided. The construction vehicle includes a frame. The construction vehicle also includes a linkage assembly coupled to the frame. The linkage assembly includes a linkage member. The linkage assembly also includes a work implement movably coupled to the linkage member. The work implement includes a wall structure defining a first edge, a second edge laterally spaced apart from the first edge, and a material engaging portion extending between the first edge and the second edge. The work implement also includes a first support plate disposed proximate to the first edge of the wall structure. The first support plate defines a first opening proximate to the material engaging portion of the wall structure. The work implement further includes a second support plate disposed proximate to the second edge of the wall structure. The second support plate defines a second opening proximate to the material engaging portion of the wall structure. The second opening is in alignment with the first opening in the first support plate. The work implement includes a conduit coupled to the first support plate and the second support plate and defining a cavity. Each of the first and second openings are aligned with the cavity. Further, the work implement also includes a weight member removably received within the cavity defined by the conduit.

In another aspect of the present disclosure, a dozer is provided. The dozer includes a frame. The dozer also includes a linkage assembly coupled to the frame. The linkage assembly includes a linkage member. The linkage assembly also includes a blade movably coupled to the linkage member. The blade includes a wall structure defining a first edge, a second edge laterally spaced apart from the first edge, and a material engaging portion extending between the first edge and the second edge. The blade also includes a first support plate disposed proximate to the first edge of the wall structure. The first support plate defines a first opening proximate to the material engaging portion of the wall structure. The blade further includes a second support plate disposed proximate to the second edge of the wall structure. The second support plate defines a second opening proximate to the material engaging portion of the wall structure. The second opening is in alignment with the first opening in the first support plate. The blade includes a conduit coupled to the first support plate and the second support plate and defining a cavity. Each of the first and second openings are aligned with the cavity. Further, the blade also includes a weight member removably received within the cavity defined by the conduit.

Other features and aspects of this disclosure will be apparent from the following description and the accompanying drawings.

DETAILED DESCRIPTION

Figure 1:
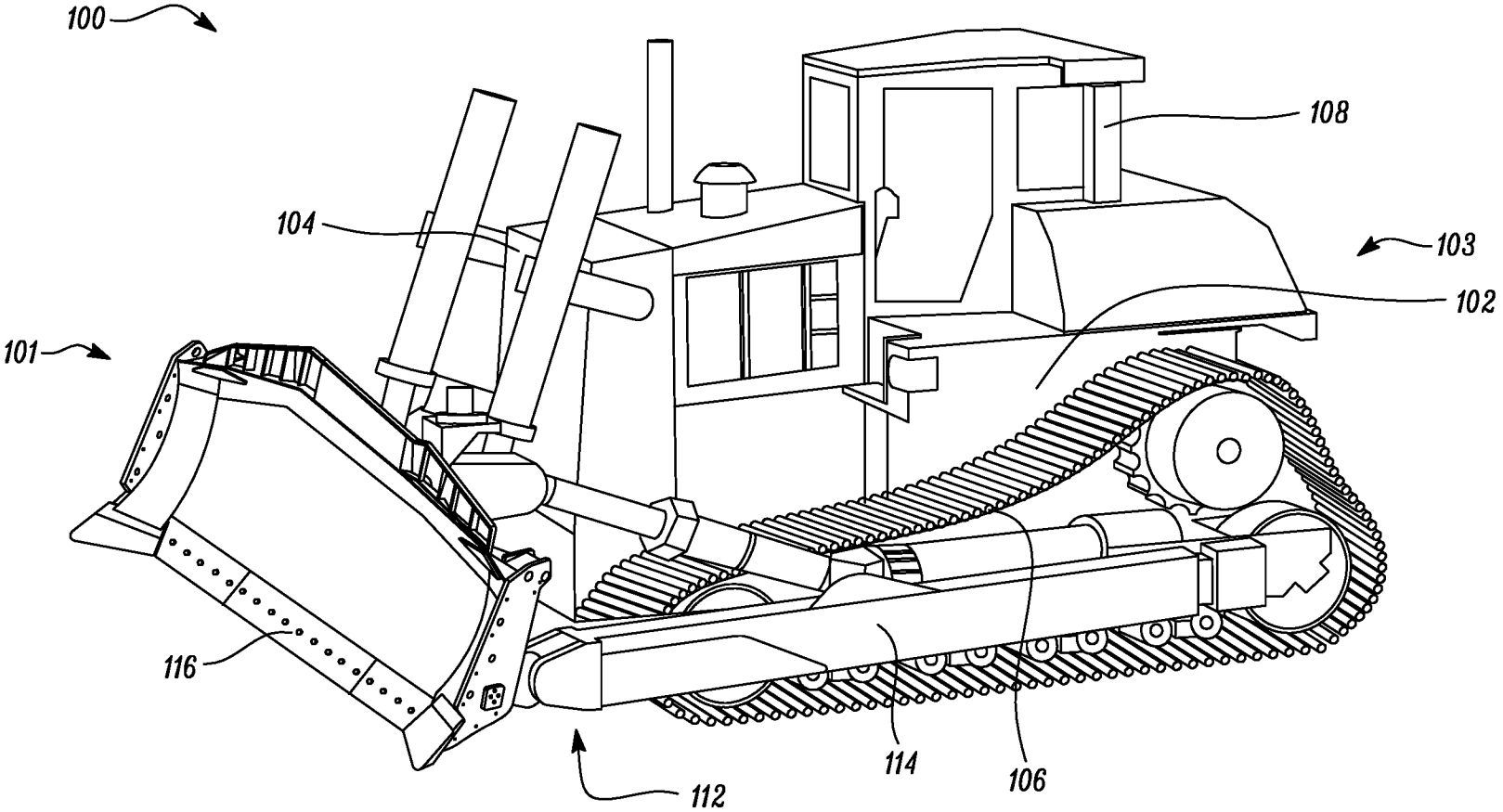
FIG. 1 is a perspective view of a construction vehicle, in accordance with the present disclosure.

Reference numerals appearing in more than one figure indicate the same or corresponding parts in each of them. References to elements in the singular may also be construed to relate to the plural and vice-versa without limiting the scope of the disclosure to the exact number or type of such elements unless set forth explicitly in the appended claims.

FIG. 1 is a perspective view of a construction vehicle 100, in accordance with the present disclosure. In the illustrated embodiment, the construction vehicle 100 is embodied as a dozer. The construction vehicle 100 may be hereinafter interchangeably referred to as the dozer 100. In alternative embodiments, the construction vehicle 100 may include a track type tractor, a motor grader, a harvester, a scraper, a motor grader, or any other type of construction vehicle known in the art. The construction vehicle 100 may perform one or more operations associated with an industry such as mining, construction, forestry, farming, transportation, or any other industry known in the art. The construction vehicle 100 may be embodied as a manual, autonomous, or semi-autonomous construction vehicle, without any limitations.

The construction vehicle 100 defines a front end 101 and a rear end 103. The construction vehicle 100 includes a frame 102. The frame 102 supports various components of the construction vehicle 100 thereon. The construction vehicle 100 also includes a power source (not shown) that provides power for mobility and/or other operational purposes. The power source may include an engine, a battery, and the like. The power source is mounted within an enclosure 104 that is defined proximate to the front end 101 of the construction vehicle 100.

The construction vehicle 100 includes a pair of ground engaging members 106 (one of which is illustrated herein) each of which is embodied as a track in the illustrated embodiment of FIG. 1. The ground engaging members 106 rotate in order to propel the construction vehicle 100 on ground surfaces. Alternatively, the ground engaging members 106 may include wheels instead of the tracks. The construction vehicle 100 also includes an operator cabin 108 supported by the frame 102. When the construction vehicle 100 is embodied as a manual or semi-autonomous construction vehicle, an operator of the construction vehicle 100 is seated within the operator cabin 108 to perform one or more operations.

Further, the construction vehicle 100 includes a linkage assembly 112 coupled to the frame 102. The linkage assembly 112 is disposed at the front end 101 of the construction vehicle 100. The linkage assembly 112 includes a linkage member 114. The linkage assembly 112 includes a pair of linkage members 114 (only one of which is illustrated herein). The linkage assembly 112 also includes a work implement 116 movably coupled to the linkage member 114. The work implement 116 may be used to perform one or more work operations. The work implement 116 may be used to engage, penetrate, or cut a work surface. In some examples, the work implement 116 may be used to perform a grading operation, a scraping operation, a leveling operation, a material removal operation, or any other type of geography altering operation at a worksite. The work implement 116 is embodied as a blade herein. The work implement 116 may be hereinafter interchangeably referred to as the blade 116. The work implement 116 may be movable based on operation of one or more actuators (not shown) associated with the linkage assembly 112. Further, the actuators may be operated by a hydraulic system or a pneumatic system of the construction vehicle 100. The construction vehicle 100 may additionally include another work implement (not shown), such as a ripper, coupled at the rear end 103 of the construction vehicle 100.

Figure 2:
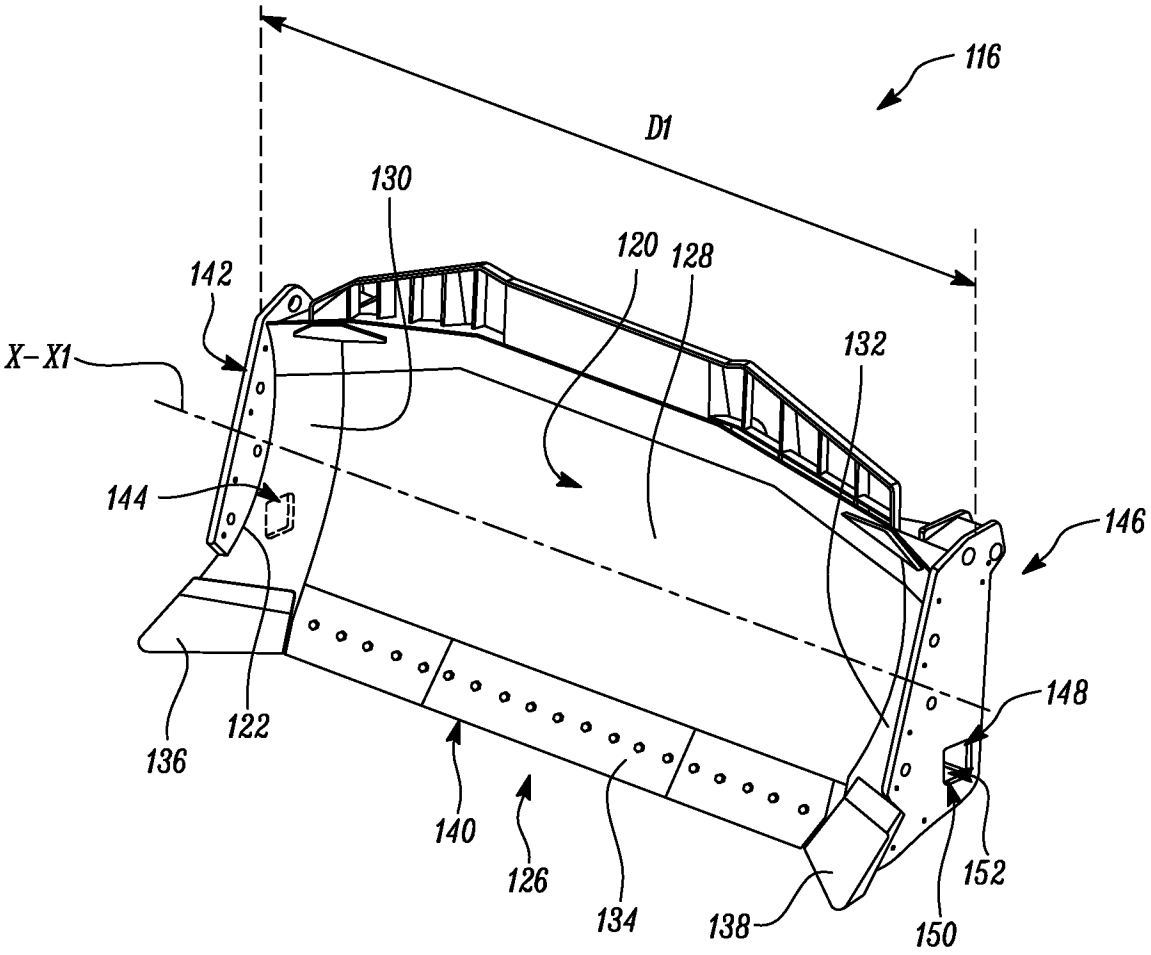
FIG. 2 is a perspective view of a work implement associated with the construction vehicle of FIG. 1, in accordance with the present disclosure.

Referring to FIG. 2, the work implement 116 defines a lateral axis X-X1. The work implement 116 also includes a wall structure 120. The wall structure 120 is generally concave in shape. The wall structure 120 defines a first edge 122, a second edge 124 (shown in FIG. 4) laterally spaced apart from the first edge 122, and a material engaging portion 126 extending between the first edge 122 and the second edge 124. More particularly, the first edge 122 and the second edge 124 are spaced apart from each other along the lateral axis X-X1.

Further, the wall structure 120 defines a central surface 128 and a pair of end surfaces 130, 132. More particularly, the first end surface 130 defines the first edge 122 and the second end surface 132 defines the second edge 124. Further, the material engaging portion 126 defines a central section 134 extending from the central surface 128, a first section 136 extending from the first end surface 130, and a second section 138 extending from the second end surface 132. Further, the central section 124 includes multiple sub-sections that can be individually controlled, as per requirements. Moreover, the material engaging portion 126 defines a cutting edge 140 for contacting and subsequently altering the work surface. The central section 134, the first section 136, and the second section 138 together define the cutting edge 140. Further, in some examples, the work implement 116 may include a number of ground engaging tools coupled to the material engaging portion 126.

The work implement 116 also includes a first support plate 142 disposed proximate to the first edge 122 of the wall structure 120. The first support plate 142 is coupled to the wall structure 120. The first support plate 142 is generally perpendicular to the lateral axis X-X1. Further, the first support plate 142 includes a generally planar profile. The first support plate 142 defines a first opening 144 proximate to the material engaging portion 126 of the wall structure 120. The first opening 144 is embodied as a through-opening. Further, the first opening 144 is substantially square in shape. Alternatively, the first opening 144 may have a different shape, for example, the first opening 144 may be rectangular shaped, circular shaped, and the like, without any limitations.

The work implement 116 includes a second support plate 146 disposed proximate to the second edge 124 of the wall structure 120. The second support plate 146 is coupled to the wall structure 120. The second support plate 146 is generally perpendicular to the lateral axis X-X1. Further, the second support plate 146 includes a generally planar profile. Moreover, a distance "D1" is defined between the first support plate 142 and the second support plate 146. The second support plate 146 defines a second opening 148 proximate to the material engaging portion 126 of the wall structure 120. The second opening 148 is in alignment with the first opening 144 in the first support plate 142. It should be noted that the first and second openings 144, 148 are similar in shape and dimensions. The second opening 148 is embodied as a through-opening. Further, the second opening 148 is substantially square in shape. Alternatively, the second opening 148 may have a different shape, for example, the second opening 148 may be rectangular shaped, circular shaped, and the like, without any limitations.

The first support plate 142 and the second support plate 146 may be removably or fixedly coupled to the wall structure 120 of the work implement 116. In an example, the first support plate 142 and the second support plate 146 may be removably coupled with the work implement 116 using mechanical fasteners, such as bolts or screws. In another example, the first support plate 142 and the second support plate 146 may be coupled to the wall structure 120 by welding, soldering, brazing, and the like. In yet another example, the wall structure 120, the first support plate 142, and the second support plate 146 may be integrally coupled with each other.

Figure 3:
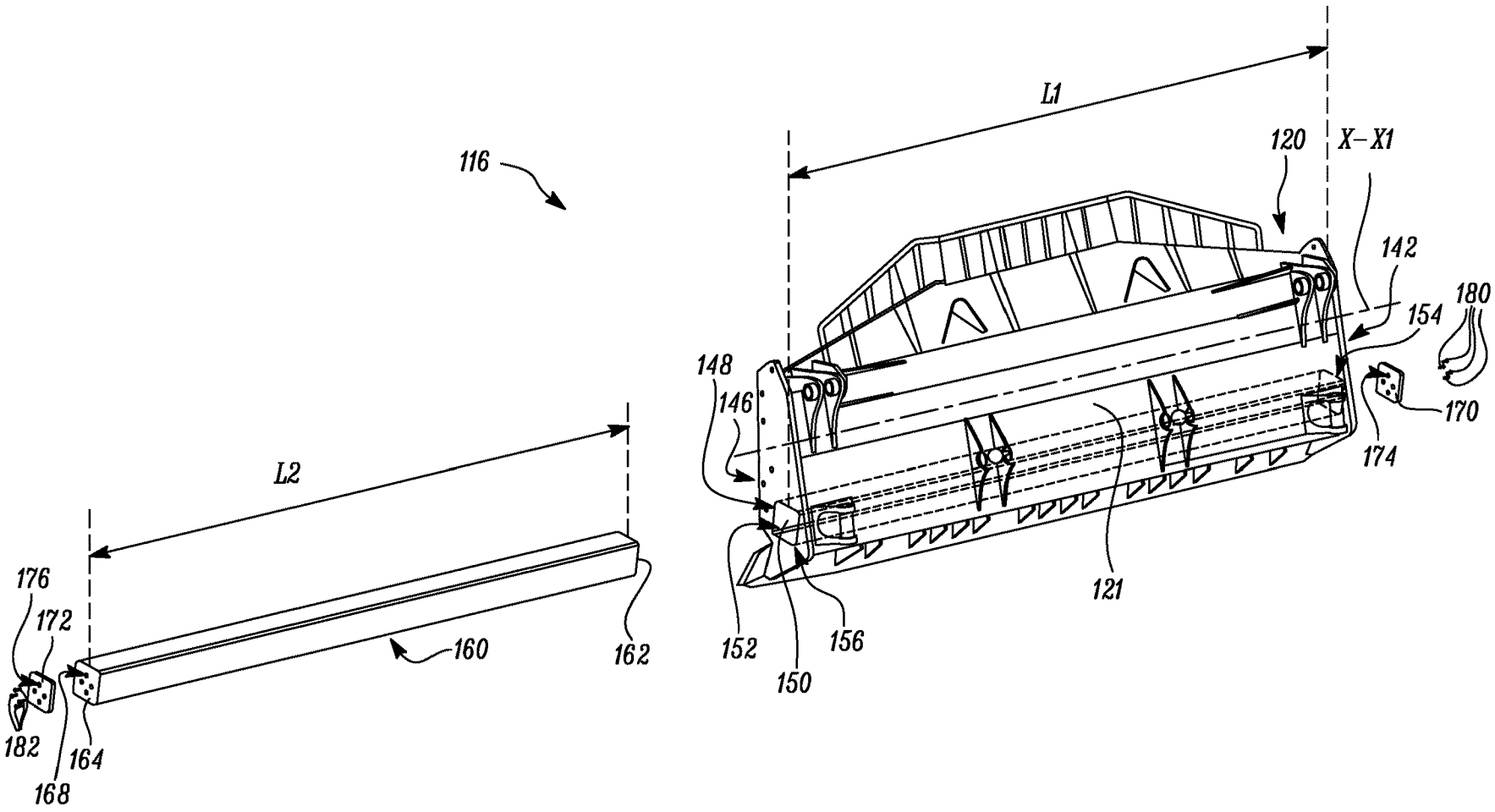
FIG. 3 is an exploded view of the work implement of FIG. 2.

Referring to FIG. 3, the work implement 116 includes a rear surface 121. The rear surface 121 includes a number of hinges, brackets, and the like to movably couple the work implement 116 with the linkage member 114 (see FIG. 1). The first support plate 142 and the second support plate 146 are generally perpendicular to the rear surface 121. The work implement 116 includes a conduit 150 coupled to the first support plate 142 and the second support plate 146 and defining a cavity 152. The conduit 150 is embodied as a hollow tube herein. Further, the conduit 150 may be made of a metal, such as steel. Alternatively, the conduit 150 may be made of other metals or alloys, without any limitations. The conduit 150 defines a first end 154 and a second end 156. As disclosed earlier, each of the first and second openings 144, 148 are in alignment with the cavity 152. Further, each of the first and second openings 144, 148 receive a portion of the conduit 150. More particularly, the first opening 144 receives a portion of the conduit 150 proximate to the first end 154. Whereas, the second opening 148 receives a portion of the conduit 150 proximate to the second end 156.

In the illustrated embodiment, the conduit 150 is welded to the first support plate 142 and the second support plate 146. More particularly, the conduit 150 is welded to the first support plate 142 around the first opening 144 (see FIG. 2) and to the second support plate 146 around the second opening 148. A shape of a cross-section of the conduit 150 corresponds to the shape of the first and second openings 144, 148. In the illustrated embodiment, the conduit 150 includes a square cross-section. Alternatively, the conduit 150 may include a rectangular cross-section, a circular cross-section, and the like, without any limitations. Dimensions of the cross-section of the conduit 150 may be substantially equal to or slightly lesser than the dimensions of the first opening 144 and the second opening 148 to allow passage of the conduit 150 through the first and second openings 144, 148. Further, the conduit 150 defines a length "L1". In the illustrated example, the length L1 of the conduit 150 is substantially equal to the distance D1 between the first support plate 142 and the second support plate 146.

Further, the conduit 150 defines the cavity 152. In the illustrated embodiment, the cavity 152 is embodied as a passage that extends along the entire length "L1" of the conduit 150. The cavity 152 may be square shaped, rectangular shaped, or circular shaped. In the illustrated example, the cavity 152 is square shaped. It should be noted that a shape of the cavity 152 may vary based on the cross-section of the conduit 150. Further, the conduit 150 is coupled to the first and second support plates 142, 146 such that the cavity 152 is accessible to the operator or personnel.

As illustrated herein, the work implement 116 includes a weight member 160 removably received within the cavity 152 defined by the conduit 150. The weight member 160 is embodied as a tube or solid bar herein. Further, the weight member 160 may be made of a metal, such as steel, concrete, sand, gravel etc. Alternatively, the weight member 160 may be made of other metals or alloys, without any limitations. The weight member 160 defines a first side surface 162 and a second side surface 164. When the weight member 160 is received within the cavity 152, the first side surface 162 is disposed proximate to the first support plate 142 and the second side surface 164 is disposed proximate to the second support plate 146. In the illustrated example, the first side surface 162 includes a number of first apertures (not shown) and the second side surface 164 includes a number of second apertures 168.

In the illustrated example, a single weight member 160 is illustrated. The weight member 160 defines a length "L2". Further, the length L2" of the weight member 160 received within the conduit 150 may be substantially equal to the length L1 of the conduit 150. Alternatively, the length L2 of the weight member 160 may be less than the length L1 of the conduit 150.

In another example, the work implement 116 may include multiple weight members 160 having different weights and lengths. For example, based on a desired weight that needs to be added to the work implement 116, the work implement 116 may include a single weight member 160 or the work implement 116 may include multiple weight members 160 having shorter lengths. Further, in some examples, spacers (not shown) may be provided within the cavity 152 such that a combined length of the multiple weight members 160 and the spacers is substantially equal to the length "L1" of the conduit 150. For example, when the work implement 116 includes multiple weight members 160, the spacers may be provided between adjacent weight members 160. The spacers may eliminate lateral movement or shifting of the weight members 160 within the cavity 152 of the conduit 150.

Further, the weight of the weight member 160 may be varied as per application requirements. In some examples, additional weights may be received within the cavity 152 to increase the weight at the front end 101 (see FIG. 1) of the construction vehicle 100. In some cases, wherein a lower amount of additional weight is required, the weight member 160 may embody a hollow tube or the work implement 116 may omit the weight member 160. In some case, when the cavity 152 is without the weight member 160, the cavity 152 may be used to house various sensors, devices, and items such as blade sensor masts, spare parts etc.

In the illustrated embodiment, a shape of the weight member 160 corresponds to the shape of the cavity 152. As illustrated, the weight member 160 is square shaped. Alternatively, the weight member 160 may have a different shape, such as a rectangular shape, a circular shape, and the like.

Figure 4:
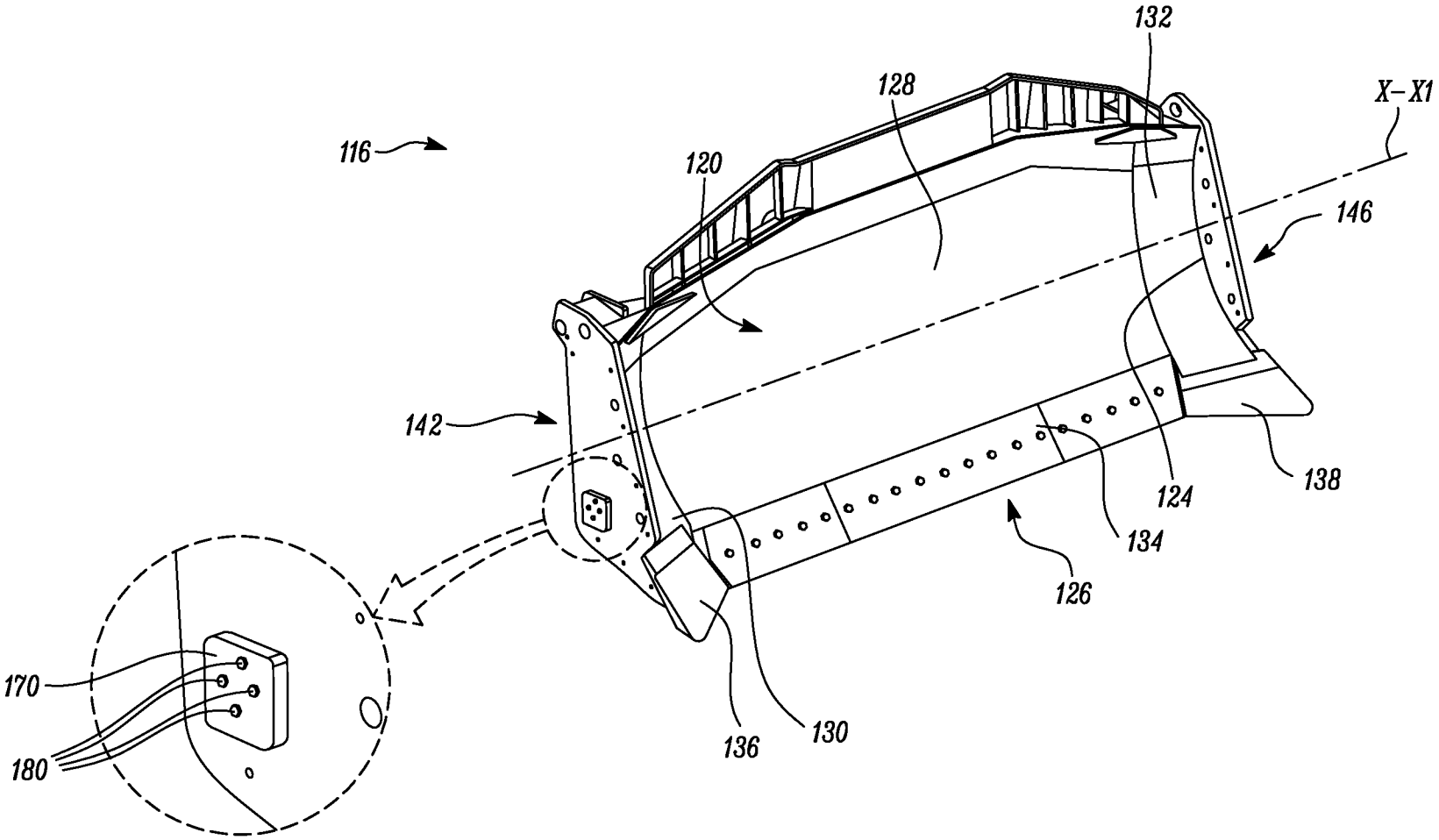
FIG. 4 is a perspective view of the work implement of FIG. 2.

Referring to FIGS. 3, and 4, the work implement 116 includes an end cap 170, 172 (shown in FIG. 3) coupled to the side surface 162, 164 (see FIG. 3) of the weight member 160 (see FIG. 2). The present disclosure illustrates two end caps 170, 172, i.e., the first end cap 170 and the second end cap 172. More particularly, the work implement 116 includes the first end cap 170 coupled to the first side surface 162 of the weight member 160 and the second end cap 172 coupled to the second side surface 164 of the weight member 160. In other embodiments, the work implement 116 may include any one end cap 170, 172, without limiting the scope of the present disclosure.

In the illustrated embodiment, a size of the end cap 170, 172 is greater than or equal to the size of the cavity 152 (see FIG. 3). Further, a shape of the end cap 170, 172 may correspond to the shape of the weight member 160. In other examples, the shape of the end caps 170, 172 may be different from the shape of the weight member 160. As illustrated herein, the end caps 170, 172 are square shaped. Alternatively, the end caps 170, 172 may be rectangular in shape, circular in shape, and the like.

Further, the first end cap 170 defines a number of first through-holes 174 (see FIG. 3) and the second end cap 172 defines a number of second through-holes 176 (see FIG. 3). In the illustrated example, the end cap 170, 172 is coupled to the side surface 162, 164 of the weight member 160 by a number of mechanical fasteners 180, 182 (shown in FIG. 3). More particularly, the first through-holes 174 in the first end cap 170 align with the first apertures in the weight member 160 to receive the mechanical fasteners 180 for coupling the first end cap 170 with the weight member 160. Moreover, the second through-holes 176 in the second end cap 172 align with the second apertures 168 (see FIG. 3) in the weight member 160 to receive the mechanical fasteners 182 for coupling the second end cap 172 with the weight member 160. The mechanical fasteners 180, 182 may be embodied as bolts, screw, rivets, or any other fasteners known in the art.

Alternatively, the first end cap 170 or the second end cap 172 may be fixed with the weight member 160, while the other may be removably coupled using the corresponding mechanical fasteners 180, 182 to facilitate insertion and removal of the weight member 160. In such an example, the first end cap 170 or the second end cap 172 may be fixedly coupled to the weight member 160 by welding.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The present disclosure relates to the work implement 116 for the construction vehicle 100. The work implement 116 includes the conduit 150 and the weight member 160 that act as a counterweight to maintain weight and balance of the construction vehicle 100. The present disclosure provides a quick and easy to implement solution for varying the weight at the front end 101 of the construction vehicle 100 by introduction of the conduit 150 and the weight member 160. Further, the weight member 160 may be added or removed at the worksite, as per requirements.

The teachings of the present disclosure may be applied to existing work implements with minimum modifications to the work implements. The conduit 150 and the weight member 160 are positioned proximate to the material engaging portion 126, i.e., a base of the work implement 116. Thus, a center of gravity (CG) of the work implement 116 is proximate to the base of the work implement 116 which in turn provides implementation benefits such as improved balance and control of the work implement 116. Moreover, positioning of the conduit 150 and the weight member 160 proximate to the material engaging portion 126 may also improve performance of the construction vehicle 100 and facilitate convenient handling of the weight member 160. For example, a personnel may easily insert or remove the weight member 160 without using any additional equipment.

The conduit 150 is welded to the first and second support plates 142, 146 thereby ensuring that any foreign particles or liquids do not enter a structure of the work implement 116. Thus, damage of the work implement 116 due to rusting may be eliminated. Further, the present disclosure allows introduction of the single or multiple weight members 160 having different lengths, weights, shapes, types, and numbers of within the cavity 152. Thus, the weight of the weight member 160 may be easily varied by introducing multiple weight members 160 or any other additional weights, as per requirements. Moreover, the work implement 116 may also include spacers to restrict any lateral shifting of the single or multiple weight members 160.

The work implement 116 includes the end caps 170, 172 i.e. the first end cap 170 and the second end cap 172 for securing the weight member 160 within the cavity 152. The end caps 170, 172 have a simple design. Further, the first end cap 170 and the second end cap 172 allow closing of the first opening 144 and the second opening 148, respectively, thereby eliminating entry of foreign particles or liquids into the structure of the work implement 116. Further, the end caps 170, 172 allow easy removal and insertion of the weight member 160 within the cavity 152. The end caps 170, 172 eliminate loosening or removal of the weight member 160 during operation of the construction vehicle 100. The end caps 170, 172 also restrict any inadvertent movement of the weight member 160.

While aspects of the present disclosure have been particularly shown and described with reference to the embodiments above, it will be understood by those skilled in the art that various additional embodiments may be contemplated by the modification of the disclosed construction vehicles, systems, methods and processes without departing from the spirit and scope of what is disclosed. Such embodiments should be understood to fall within the scope of the present disclosure as determined based upon the claims and any equivalents thereof.

What is claimed is:

1. A construction vehicle comprising:
- a frame; and
- a linkage assembly coupled to the frame, wherein the linkage assembly includes:
  - a linkage member; and
  - a work implement movably coupled to the linkage member, the work implement including:
    - a wall structure defining a first edge, a second edge laterally spaced apart from the first edge, and a material engaging portion extending between the first edge and the second edge;
    - a first support plate disposed proximate to the first edge of the wall structure, wherein the first support plate defines a first opening proximate to the material engaging portion of the wall structure;
    - a second support plate disposed proximate to the second edge of the wall structure, wherein the second support plate defines a second opening proximate to the material engaging portion of the wall structure, the second opening being in alignment with the first opening in the first support plate;
    - a hollow tube coupled to the first support plate and the second support plate and defining a cavity, wherein each of the first and second openings are aligned with the cavity;
    - a counterweight removably received within the cavity defined by the hollow tube;
    - a first end cap coupled to a first side surface of the counterweight over the first opening; and
    - a second end cap coupled to a second side surface of the counterweight over the second opening,
      - wherein at least one of the first side surface or the second side surface of the counterweight includes one or more apertures.

2. The construction vehicle of claim 1, wherein the first end cap and the second end cap are coupled to the respective first side surface and second side surface of the counterweight by a plurality of mechanical fasteners that are disposed in the one or more apertures.

3. The construction vehicle of claim 1, wherein a size of the first end cap and the second end cap is greater than or equal to a size of the cavity.

4. The construction vehicle of claim 1, wherein a shape of the first end cap and the second end cap corresponds to a shape of the counterweight.

5. The construction vehicle of claim 1, wherein the hollow tube is welded to the first support plate and the second support plate.

6. The construction vehicle of claim 1, wherein a shape of the cavity is at least one of square shaped, rectangular shaped, or circular shaped.

7. The construction vehicle of claim 6, wherein a shape of the counterweight corresponds to the shape of the cavity.

8. The construction vehicle of claim 1, wherein the first end cap is disposed entirely outside the first opening, and wherein the second end cap is disposed entirely outside the second opening.

9. A dozer comprising:
a frame; and
a linkage assembly coupled to the frame, wherein the linkage assembly includes:
a linkage member; and
a blade movably coupled to the linkage member, the blade including:
a wall structure defining a first edge, a second edge laterally spaced apart from the first edge, and a material engaging portion extending between the first edge and the second edge;
a first support plate disposed proximate to the first edge of the wall structure, wherein the first support plate defines a first opening proximate to the material engaging portion of the wall structure;
a second support plate disposed proximate to the second edge of the wall structure, wherein the second support plate defines a second opening proximate to the material engaging portion of the wall structure, the second opening being in alignment with the first opening in the first support plate;
a conduit coupled to the first support plate and the second support plate and defining a cavity, wherein the conduit is a hollow tube, and wherein each of the first and second openings are aligned with the cavity; and
a counterweight removably received within the cavity defined by the conduit,
wherein the counterweight is variable based on a desired weight of the blade.

10. The dozer of claim 9, wherein a side surface of the counterweight includes one or more apertures, and wherein the blade includes an end cap coupled to the side surface of the counterweight.

11. The dozer of claim 10, wherein the end cap is coupled to the side surface of the counterweight by a plurality of mechanical fasteners.

12. The dozer of claim 10, wherein the end cap is a first end cap coupled to a first side surface of the counterweight, and wherein the blade further includes a second end cap coupled to a second side surface of the counterweight.

13. The dozer of claim 10, wherein a size of the end cap is greater than or equal to a size of the cavity.

14. The dozer of claim 10, wherein a shape of the end cap corresponds to a shape of the counterweight.

15. The dozer of claim 9, wherein the conduit is welded to the first support plate and the second support plate.

16. The dozer of claim 9, wherein a shape of the cavity is at least one of square shaped, rectangular shaped, or circular shaped.

17. The dozer of claim 9, wherein a length of the conduit is substantially equal to a distance between the first support plate and the second support plate.

18. The dozer of claim 9, wherein the counterweight is interchangeable with one or more other counterweights associated with the same blade.

19. A construction vehicle comprising:
a frame; and
a linkage assembly coupled to the frame, wherein the linkage assembly includes:
a linkage member; and
a work implement movably coupled to the linkage member, the work implement including:
a wall structure defining a first edge, a second edge laterally spaced apart from the first edge, and a material engaging portion extending between the first edge and the second edge;
a first support plate disposed proximate to the first edge of the wall structure, wherein the first support plate defines a first opening proximate to the material engaging portion of the wall structure;
a second support plate disposed proximate to the second edge of the wall structure, wherein the second support plate defines a second opening proximate to the material engaging portion of the wall structure, the second opening being in alignment with the first opening in the first support plate;
a conduit coupled to the first support plate and the second support plate and defining a cavity, wherein the conduit is a hollow tube, and wherein each of the first and second openings are aligned with the cavity; and
a counterweight removably received within the cavity defined by the conduit.

20. The construction vehicle of claim 19, wherein the counterweight fits through at least one of the first opening or the second opening to be received within the cavity.

* * * * *